US005571652A

United States Patent [19]

Asano et al.

[11] Patent Number: 5,571,652

[45] Date of Patent: Nov. 5, 1996

[54] ENCAPSULATED TONER FOR HEAT-AND-PRESSURE FIXING AND METHOD FOR PRODUCING THE SAME

[75] Inventors: Tetsuya Asano; Mitsuhiro Sasaki, both of Wakayama; Takashi Yamaguchi, Arida; Kuniyasu Kawabe, Wakayama, all of Japan

[73] Assignee: Kao Corporation, Tokyo, Japan

[21] Appl. No.: 291,475

[22] Filed: Aug. 17, 1994

[30] Foreign Application Priority Data

Sep. 1, 1993 [JP] Japan ..... 5-242032

[51] Int. Cl.[6] ..... G03G 9/093

[52] U.S. Cl. ..... 430/109; 430/111; 430/137; 430/138; 430/904

[58] Field of Search ..... 430/109, 138, 430/137, 111, 904

[56] References Cited

U.S. PATENT DOCUMENTS

| | | | |
|---|---|---|---|
| 2,297,691 | 10/1942 | Carlson . | |
| 2,357,809 | 9/1944 | Carlson . | |
| 3,269,626 | 8/1966 | Albrecht . | |
| 5,225,308 | 7/1993 | Sasaki et al. | 430/138 |
| 5,428,435 | 6/1995 | Yasuda et al. | 430/109 |

FOREIGN PATENT DOCUMENTS

| | | |
|---|---|---|
| 0536651 | 4/1993 | European Pat. Off. . |
| 0552785 | 7/1993 | European Pat. Off. . |
| 0587036 | 3/1994 | European Pat. Off. . |
| 0615167 | 9/1994 | European Pat. Off. . |
| 2245981 | 1/1992 | United Kingdom . |

OTHER PUBLICATIONS

Patent Abstracts of Japan, vol. 12, No. 25 (P–659) [2872] (Jan. 26, 1988), of JP 62–178269 (Pub Aug. 1987).
English Abstract of JP 48–075032 corresponds to U.S. Patent No. 3,788, 994. (Pub Oct. 1973).
English Abstract of JP 82000493 (Pub Jan. 1982).
English Abstract of JP 50044836 (Pub Apr. 1975).
English Abstract of JP 57037353 (Pub Mar. 1982).
English Abstract of JP 48075033 (Pub Oct. 1973).
English Abstract of JP 61056352 (Pub Mar. 1986).
English Abstract of JP 58205163 (Pub Nov. 1983).
English Abstract of JP 58205162 (Pub Nov. 1983).
English Abstract of JP 63128357 (Pub May 1988).
English Abstract of JP 63128358 (Pub May 1988).
English Abstract of JP 63128359 (Pub May 1988).
English Abstract of 63128360 (Pub May 1988).
English Abstract of 63128361 (Pub May 1988).
English Abstract of 63128362 (Pub May 1988).
English Abstract of 6130713 (Pub May 1994).

*Primary Examiner*—Janis L. Dote
*Attorney, Agent, or Firm*—Birch, Stewart, Kolasch & Birch, LLP

[57] ABSTRACT

The encapsulated toner for heat-and-pressure fixing which includes a heat-fusible core material containing at least a thermoplastic resin and a coloring agent, and a shell formed thereon so as to cover the surface of the core material is produced by a process having the step of carrying out in situ polymerization using a thermoplastic resin as a main component of the shell to form a shell having a structure in which a part of the heat-fusible core material is incorporated therein, the thermoplastic resin having a mechanical loss tangent (tan δ) in the range of from 1.0 to 20.0 based on a dynamic viscoelasticity, when measured with a sine stress having an angular frequency of 25 rad/s at a temperature of from 80° to 120° C. By using the encapsulated toner, good offset resistance can be obtained in the resulting toner even when its fixing speed is slow. Also, the core material is likely to be released from the encapsulated toner upon fixing while retaining good blocking resistance and good shocking resistance.

9 Claims, 3 Drawing Sheets

1 μm

ENCAPSULATED TONER FOR HEAT-AND-PRESSURE FIXING AND METHOD FOR PRODUCING THE SAME

BACKGROUND OF THE INVENTION

1. Field of the Invention

The present invention relates to an encapsulated toner for heat-and-pressure fixing used for development of electrostatic latent images in electrophotography, electrostatic printing, or electrostatic recording, and to a method for producing such an encapsulated toner.

2. Discussion of the Related Art

As described in U.S. Pat. Nos. 2,297,691 and 2,357,809 and other publications, conventional electrophotography comprises the steps of forming an electrostatic latent image by evenly charging a photoconductive insulating layer, subsequently exposing the layer to eliminate the charge on the exposed portion and visualizing the formed image by adhering colored charged fine powder, known as a toner, to the latent image (a developing process); transferring the obtained visible image to an image-receiving sheet such as a transfer paper (a transfer process); and permanently fixing the transferred image by heating, pressure application or other appropriate means of fixing (a fixing process).

As indicated above, the toner must meet the requirements not only of the development process, but also of the transfer process and the fixing process.

Generally, a toner undergoes mechanical frictional forces due to shear force and impact force during the mechanical operation in a developer device, and deteriorates after copying from several thousands to several ten thousands of sheets. The deterioration of the toner can be prevented by using a tough resin having such a high molecular weight that it can withstand the above mechanical frictional forces. However, this kind of a resin generally has such a high softening point that the resulting toner cannot be sufficiently fixed by a non-contact method, such as oven fixing or radiant fixing with infrared rays, because of its poor thermal efficiency. Further, when the toner is fixed by a contact fixing method, such as a heat-and-pressure fixing method using a heat roller, which is excellent in thermal efficiency and therefore widely used, it becomes necessary to raise the temperature of the heat roller in order to achieve sufficient fixing of the toner, which brings about such disadvantages as deterioration of the fixing device, curling of the paper and an increase in energy consumption. Furthermore, the resin described above is poor in grindability, thereby remarkably lowering the production efficiency of the toner. Accordingly, the binder resin having too high of a degree of polymerization and also too high of a softening point cannot be used.

Meanwhile, according to the heat-and-pressure fixing method using a heat roller, the surface of a heat roller contacts the surface of a visible image formed on an image-receiving sheet under pressure, so that the thermal efficiency is excellent and therefore widely used in various high-speed and low-speed copy machines. However, when the surface of a heat roller contacts the surface of the visible image, the toner is likely to cause a so-called "offset phenomenon," wherein the toner is adhered to the surface of the heat roller, and thus transferred to a subsequent transfer paper. In order to prevent this phenomenon, the surface of a heat roller is coated with a material having excellent release properties for the toner, such as a fluororesin, and further a releasing agent such as a silicone oil is applied thereon. However, the method of applying a silicone oil necessitates a larger-scale fixing device, which is not only expensive but also complicated, which in turn may undesirably cause various problems.

Although processes for improving the offset phenomenon by unsymmetrizing or crosslinking the resins have been disclosed in Japanese Patent Examined Publication No. 57-493 and Japanese Patent Laid-Open Nos. 50-44836 and 57-37353, the fixing temperature has not yet been improved by these processes.

Since the lowest fixing temperature of a toner is generally between the temperature of low-temperature offsetting of the toner and the temperature of the high-temperature offsetting thereof, the serviceable temperature range of the toner is from the lowest fixing temperature to the temperature for high-temperature offsetting. Accordingly, by lowering the lowest fixing temperature as much as possible and raising the temperature at which high-temperature offsetting occurs as much as possible, the serviceable fixing temperature can be lowered and the serviceable temperature range can be widened, which enables energy saving, high-speed fixing and prevention of curling of paper.

From the above reasons, the development of a toner having excellent fixing ability and offset resistance has always been desired.

A method has been proposed to achieve low-temperature fixing by using an encapsulated toner comprising a core material and a shell formed thereon so as to cover the surface of the core material.

Among such toners, those having a core material made of a low-melting wax which is easily plastically deformable, as described in U.S. Pat. No. 3,269,626, Japanese Patent Examined Publication Nos. 46-15876 and 44-9880, and Japanese Patent Laid-Open Nos. 48-75032 and 48-75033, are poor in fixing strength and therefore can be used only in limited areas, although they can be fixed only by pressure.

Further, with respect to toners having a liquid core material, when the strength of the shell is low, the toners tend to break in the developing device and stain the inside thereof, though they can be fixed only by pressure. On the other hand, when the strength of the shell is high, a higher pressure is necessitated in order to break the capsule, thereby giving images that are too glossy. Thus, it has been difficult to control the strength of the shell.

Further, there has been proposed, as a toner for heat-and-pressure fixing, an encapsulated toner for heat roller fixing which comprises a core material made of a resin having a low glass transition temperature which serves to enhance the fixing strength, though blocking at a high temperature may take place if used alone, and a shell of a high-melting point resin wall which is formed by interfacial polymerization for the purpose of imparting a blocking resistance to the toner. However, in Japanese Patent Laid-Open No. 61-56352, this toner cannot fully exhibit the performance of the core material, because the melting point of the shell material is too high and also the shell is too tough and not easily breakable. On the same line of thinking as that described above, encapsulated toners for heat roller fixing with an improved fixing strength of the core material have been proposed (see Japanese Patent Laid-Open Nos. 58-205162, 58-205163, 63-128357, 63-128358, 63-128359, 63-128360, 63-128361, and 63-128362). However, since these toners are prepared by a spray drying method, a higher load to the equipments for the production thereof becomes necessary. In addition, they cannot fully exhibit the performance of the core material, because they have not come up with a solution for the problems in the shell.

Therefore, an encapsulated toner using a compound having thermal dissociation property as a shell material (Japanese Patent Laid-Open No. 4-212169) and an encapsulated toner using an amorphous polyester as a shell material have been proposed (Japanese Patent Laid-Open No. 6-130713).

When a thermoplastic resin such as an amorphous polyester is used as a shell material, in order to sufficiently exhibit a good fixing performance of the core material, the following methods may be employed. For instance, a thickness of the shell is reduced. Alternatively, a resin having a narrow molecular weight distribution and a low softening point may be used in the production of a toner so as to quickly melt the resin at a fixing temperature of the toner. However, when the thickness of the shell is reduced, a toner having a core material surface partly exposed without being fully covered with the shell-forming material is likely to be produced, thereby making the amount control of the shell-forming material difficult. Also, in the case of using the resin quickly melting in a narrow temperature range, where the copying speed and printing speed are low, the resin melts excessively, so that it is likely to be adhered onto a fixing roller. Therefore, offset phenomenon undesirably takes place, due to the shell material properties. As a result, the thermoplastic resin to be used as a shell material has to have a sufficient elasticity in a given fixing temperature range.

SUMMARY OF THE INVENTION

An object of the present invention is to provide an encapsulated toner for heat-and-pressure fixing which has excellent offset resistance even when its fixing speed is low, is fixable at a low temperature range, and has excellent blocking resistance, in the heat-and-pressure fixing method using, for instance, a heat roller.

Another object of the present invention is to provide a method of producing such an encapsulated toner.

As a result of intensive research in view of solving the above-mentioned problems, the present inventors have found that by using a thermoplastic resin having a particular viscoelasticity as the main component of the shell for the encapsulated toner, the obtained shell has a particular three-dimensional network structure or islands-sea structure, and have thus completed the present invention.

The present invention is concerned with the following:

(1) An encapsulated toner for heat-and-pressure fixing comprising a heat-fusible core material containing at least a thermoplastic resin and a coloring agent, and a shell formed thereon so as to cover the surface of the core material, the shell having a structure in which a part of the heat-fusible core material is incorporated therein; and (2) A method for producing an encapsulated toner for heat-and-pressure fixing comprising a heat-fusible core material containing at least a thermoplastic resin and a coloring agent, and a shell formed thereon so as to cover the surface of the core material, the method comprising the step of carrying out in situ polymerization using a thermoplastic resin as a main component of the shell to form a shell having a structure in which a part of the heat-fusible core material is incorporated therein, the thermoplastic resin having a mechanical loss tangent (tan δ) in the range of from 1.0 to 20.0 based on a dynamic viscoelasticity, when measured with a sine stress having an angular frequency of 25 rad/s at a temperature of from 80° to 120° C.

In the present invention, by using a thermoplastic resin having a given viscoelasticity as the main component of the shell, good offset resistance can be obtained in the resulting toner even when its fixing speed is slow. Also, by forming the shell having a three-dimensional network structure or an islands-sea structure in which a part of the heat-fusible core material is incorporated therein, the core material is likely to be released from the encapsulated toner upon fixing while retaining good blocking resistance and good shocking resistance.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
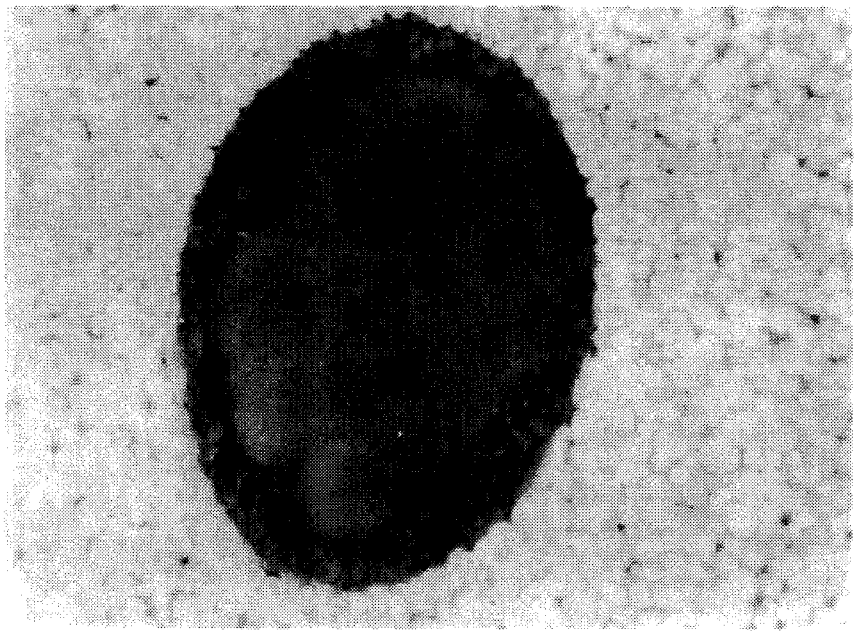
FIG. 1 is a microphotograph showing a grain structure of Toner 1 obtained in Example 1 by observing a cross section of Toner 1 using a transmission electron microscope.

The encapsulated toner for heat-and-pressure fixing of the present invention has a shell having a structure containing a part of a core material.

More specifically, when a cross section of a toner is observed by a transmission electron microscope, a layer of the shell shows a three-dimensional network structure or an islands-sea structure. In the above shell, a part of the core material may be incorporated in the three-dimensional network structure, or a part of the core material may be present as "islands" in the islands-sea structure. By having the structure mentioned above, the core material is likely to be released from the encapsulated toner upon fixing without reducing the shell strength. In general, the thicker the thermoplastic resin layer of the shell, the higher the blocking resistance of the toner can be obtained. However, when the shell is too thick, the core material is not likely to be released from the encapsulated toner, thereby generally making it difficult to provide a sufficient fixing strength in the resulting toner. In order to solve this problem in the present invention, a part of the core material is incorporated in the shell, so that the core material is likely to be released from the encapsulated toner upon fixing while maintaining good blocking resistance and good shocking resistance.

The content of the core material in the shell layer is 10 to 90 volume %, preferably 30 to 80 volume %. When the content of the core material in the shell layer is less than 10 volume %, sufficient effects for incorporating the core material into the shell cannot be obtained, and when the content exceeds 90 volume %, the shell resin undesirably becomes too thin, thereby making the storage stability of the toner poor. Within the above range, a low content of the core material in the shell layer tends to give an islands-sea structure, and a high content thereof tends to give a three-dimensional network structure.

The methods for forming a shell having the structure described above are not particularly limited. For the sake of production simplicity, a method for forming a shell by in situ polymerization method is advantageously used. Specifically, the method comprises the steps of dissolving a thermoplastic resin having a particular viscoelasticity as a main component of the shell into a polymerizable composition containing monomers of the core material resin and a coloring agent; dispersing the obtained mixture in an aqueous dispersion medium; and polymerizing the monomers in the dispersed phase.

Specifically, in the encapsulated toner for heat-and-pressure fixing of the present invention, by using a thermoplastic resin having a sufficiently high elastic modulus in fixing temperature range, both a good fixing ability and a high offset resistance can be achieved in the resulting toner, even when a fixing speed is low. The thermoplastic resin to be used as the main component of the shell in the present invention has a mechanical loss tangent (tan δ) ranging from 1.0 to 20.0, preferably 1.0 to 10.0, based on a dynamic viscoelasticity, when measured with a sine stress having an angular frequency of 25 rad/s at 80° to 120° C. When the thermoplastic resin has a tan δ of less than 1.0 at a temperature of from 80° to 120° C., the thermoplastic resin becomes extremely rigid, so that its compatibility and the dispersion with the core-constituting materials become undesirably poor. Therefore, the shell is formed unevenly, thereby making the storage ability of the obtained toner poor. On the other hand, when the thermoplastic resin has a tan δ exceeding 20.0 at a temperature of from 80° to 120° C., the fluidity of the molten resin undesirably increases, so that the obtained toner is likely to be adhered onto the heat roller of the fixing device.

In the present invention, the dynamic viscoelasticity of the thermoplastic resin is measured using "DYNAMIC ANALYZER RDA II" (manufactured by Rheometrics Inc.) by placing a molten resin between two parallel discs (diameter: 25 mm, distance between discs: 2 mm), and applying a given sine stress to the molten resin via the discs. Here, the sine stress is applied so as to cause a strain at an outer circumference of a disc of ±1% (total motion length: 2%), based on the distance between the discs.

The methods for adjusting the tan δ of a thermoplastic resin in the present invention to the above range are not particularly limited. The tan δ of, for instance, an amorphous polyester may be adjusted by the method comprising the step of polymerizing alcohol monomers and acid component monomers to give a ratio of a weight-average molecular weight (Mw) to a number-average molecular weight (Mn), i.e. Mw/Mn, of not less than 5 using monomers of trihydric or higher polyhydric alcohols and/or tricarboxylic or higher polycarboxylic acid components in a total amount of not less than 5 mol %, based on the entire polyester resin monomers.

Examples of the thermoplastic resins having a particular viscoelasticity used in the present invention are not particularly limited as long as they show dynamic viscoelasticity mentioned above. For this purpose, polyester resins having a particular viscoelasticity mentioned above can be suitably used. Among them, from the viewpoint of improving fixing ability, amorphous polyesters are particularly preferred. In other words, as for the main component of the shell in the present invention, the amorphous polyesters having a given viscoelasticity mentioned above can be suitably used. Here, the amorphous polyester may be used singly as a shell component or in combination with other resins.

The amorphous polyester in the present invention can be usually obtained by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher polycarboxylic acid monomers. Among them, the amorphous polyesters obtained by the condensation polymerization of monomers essentially containing at least a trihydric or higher polyhydric alcohol monomer and/or a tricarboxylic or higher polycarboxylic acid monomer are suitably used.

Examples of the dihydric alcohols include bisphenol A alkylene oxide adducts such as polyoxypropylene(2.2)-2,2-bis(4-hydroxyphenyl)propane,
polyoxypropylene(3.3)-2,2-bis(4-hydroxyphenyl)propane,
polyoxypropylene(2.0)-2,2-bis(4-hydroxyphenyl)propane,
polyoxypropylene(2.0)-polyoxyethylene(2.0)-2,2-bis(4-hydroxyphenyl)propane, and
polyoxypropylene(6)-2,2-bis(4-hydroxyphenyl)propane;
ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, propylene adducts of bisphenol A, ethylene adducts of bisphenol A, hydrogenated bisphenol A, and other dihydric alcohols.

Examples of the trihydric or higher polyhydric alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohols.

Among the alcohols, the trihydric alcohols are preferably used.

In the present invention, these dihydric alcohol monomers and trihydric or higher polyhydric alcohol monomers may be used singly or in combination.

As for the acid components, examples of the dicarboxylic acid components include maleic acid, fumaric acid, citraconic acid, iraconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, acid anhydrides thereof, lower alkyl esters thereof, and other dicarboxylic acid components.

Examples of the tricarboxylic or higher polycarboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, acid anhydrides thereof, lower alkyl esters thereof, and other tricarboxylic or higher polycarboxylic acid components.

In the present invention, among these carboxylic acid components, a preference is given to the tricarboxylic acids or derivatives thereof.

In the present invention, these dicarboxylic acid monomers and tricarboxylic or higher polycarboxylic acid monomers may be used singly or in combination.

The method for producing an amorphous polyester in the present invention is not particularly limited, and the amorphous polyester can be produced by esterification or transesterification of the above monomers.

Here, "amorphous" refers to those which do not have a definite melting point.

The glass transition temperature of the amorphous polyester thus obtained is preferably 50° to 80° C., more preferably 55° to 70° C. When the glass transition temperature of the amorphous polyester is less than 50° C., the storage stability of the toner becomes poor, and when the glass transition temperature exceeds 80° C., the fixing ability of the resulting toner becomes undesirably poor. In the present invention, the "glass transition temperature" used herein refers to the temperature of an intersection of the extension of the baseline of not more than the glass transition temperature and the tangential line showing the maximum inclination between the kickoff of the peak and the top thereof as determined using a differential scanning calorimeter ("DSC MODEL 210," manufactured by Seiko Instruments, Inc.), at a temperature rise rate of 10° C./min.

The acid value of the above amorphous polyester is preferably 3 to 50 KOH mg/g, more preferably 10 to 30 KOH mg/g. When the acid value of the amorphous polyester is less than 3 KOH mg/g, the amorphous polyester used as the shell-forming material is less likely to be formed on the core material during in situ polymerization, thereby making the storage stability of the resulting toner poor, and when the acid value exceeds 50 KOH mg/g, the polyester is likely to shift to a water phase, thereby making the production stability poor. Here, the acid value is measured by the method according to JIS K0070.

In the present invention, the amorphous polyester described above can be contained in an amount of normally 50 to 100% by weight, based on the total weight of the shell, and the other components which may be contained in the shell include amorphous polyamides, amorphous polyesteramides, polyurethane resins, and polyurea resins in an amount of 0 to 50% by weight.

In a case where the encapsulated toner of the present invention is produced by in situ polymerization method, each of the components used for the shell, such as an amorphous polyester, has to be soluble in the monomers of the core material resin in order to dissolve the shell components in the monomers.

The resins used as the main components of the heat-fusible core material (thermoplastic core material) in the encapsulated toner of the present invention include polyester-polyamide resins, polyamide resins, and vinyl resins, with a preference given to the vinyl resins. The glass transition temperatures ascribed to the thermoplastic resin used as the main component of the heat-fusible core material mentioned above are preferably 10° C. to 50° C., more preferably 20° C. to 40° C. When the glass transition temperature ascribed to the thermoplastic resin is less than 10° C., the storage stability of the encapsulated toner becomes poor, and when the glass transition temperature exceeds 50° C., the fixing strength of the resulting encapsulated toner becomes undesirably poor.

Among the above-mentioned thermoplastic resins, examples of the monomers of the vinyl resins include styrene and styrene derivatives such as styrene, o-methylstyrene, m-methylstyrene, p-methylstyrene, α-methylstyrene, p-ethylstyrene, 2,4-dimethylstyrene, p-chlorostyrene, and vinylnaphthalene; ethylenic unsaturated monoolefins such as ethylene, propylene, butylene, and isobutylene; vinyl esters such as vinyl chloride, vinyl bromide, vinyl fluoride, vinyl acetate, vinyl propionate, vinyl formate, and vinyl caproate; ethylenic monocarboxylic acids and esters thereof such as acrylic acid, methyl acrylate, ethyl acrylate, n-propyl acrylate, isopropyl acrylate, n-butyl acrylate, isobutyl acrylate, t-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, t-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, and diethylaminoethyl methacrylate; substituted monomers of ethylenic monocarboxylic acids such as acrylonitrile, methacrylonitrile, and acrylamide; ethylenic dicarboxylic acids and substituted monomers thereof such as dimethyl maleate; vinyl ketones such as vinyl methyl ketone; vinyl ethers such as vinyl methyl ether; vinylidene halides such as vinylidene chloride; and N-vinyl compounds such as N-vinylpyrrole and N-vinylpyrrolidone.

Among the above core material resin components according to the present invention, it is preferred that styrene or styrene derivatives is used in an amount of 50 to 90% by weight to form the main structure of the resins, and that the ethylenic monocarboxylic acid or esters thereof is used in an amount of 10 to 50% by weight in order to adjust the thermal properties such as the softening point of the resins, because the glass transition temperature of the core material resin can be easily controlled.

A crosslinking agent may be added, if necessary, to the monomer composition. In such a case, any known crosslinking agents may be suitably used. Examples of crosslinking agents added to monomer compositions constituting the core material resins include any of the generally known crosslinking agents such as divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, dibromoneopentyl glycol dimethacrylate, and diallyl phthalate. Among them, a preference is given to divinylbenzene and polyethylene glycol dimethacrylate. These crosslinking agents may be used alone or, if necessary, in a combination of two or more.

The amount of these crosslinking agents used is preferably 0.001 to 15% by weight, more preferably 0.1 to 10% by weight, based on the vinyl polymerizable monomers. When the amount of these crosslinking agents used is more than 15% by weight, the resulting toner is less likely to be melted with heat, thereby resulting in poor heat fixing ability and poor heat-and-pressure fixing ability. On the contrary, when the amount used is less than 0.001% by weight, in the heat-and-pressure fixing, an offset phenomenon is likely to take place wherein a part of the toner cannot be completely fixed on a paper but rather adheres to the surface of a roller, which in turn is transferred to a subsequent paper.

A graft or crosslinked polymer prepared by polymerizing the above monomers in the presence of an unsaturated polyester may be also used as the resin for the core material.

Examples of the polymerization initiators to be used in the production of the thermoplastic resin for the core material include azo and diazo polymerization initiators such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide, and dicumyl peroxide.

For the purposes of controlling the molecular weight or molecular weight distribution of the polymer or controlling the reaction time, two or more polymerization initiators may be used in combination. The amount of the polymerization initiator used is 0.1 to 20 parts by weight, preferably 1 to 10 parts by weight, based on 100 parts by weight of the monomers to be polymerized.

In the present invention, a charge control agent may be further added to the core material. Negative charge control agents to be added are not particularly limited, and examples thereof include azo dyes containing metals such as "VARI-FAST BLACK 3804" (manufactured by Orient Chemical Co., Ltd.), "BONTRON S-31" (manufactured by Orient Chemical Co., Ltd.), "BONTRON S-32" (manufactured by Orient Chemical Co., Ltd.), "BONTRON S-34" (manufactured by Orient Chemical Co., Ltd.), "AIZEN SPILON BLACK T-77" (manufactured by Hodogaya Chemical Co., Ltd.), and "AIZEN SPILON BLACK TRH" (manufactured by Hodogaya Chemical Co., Ltd.); copper pthalocyanine dye; metal complexes of alkyl derivatives of salicylic acid such as "BONTRON E-81" (manufactured by Orient Chemical Co., Ltd.), "BONTRON E-82" (manufactured by Orient Chemical Co., Ltd.), and "BONTRON E-85" (manufactured by Orient Chemical Co., Ltd.); quaternary ammonium salts such as "COPY CHARGE NX VP434" (manufactured by Hoechst); and nitroimidazole derivatives, with a preference given to AIZEN SPILON BLACK T-77 and AIZEN SPILON BLACK TRH.

The positive charge control agents are not particularly limited, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), cetyltrimethylammonium bromide, and "COPY CHARGE PX VP435" (manufactured by Hoechst); polyamine resins such as "AFP-B" (manufactured by Orient Chemical Co., Ltd.); and imidazole derivatives, with a preference given to BONTRON N-07 and AFP-B.

The above charge control agents may be contained in the core material in an amount of 0.1 to 8.0% by weight, preferably 0.2 to 5.0% by weight.

If necessary, the core material may contain one or more suitable offset inhibitors for the purpose of improving the offset resistance in heat-and-pressure fixing, and examples of the offset inhibitors include polyolefins, metal salts of fatty acids, fatty acid esters, partially saponified fatty acid esters, higher fatty acids, higher alcohols, paraffin waxes, amide waxes, polyhydric alcohol esters, silicone varnish, aliphatic fluorocarbons, and silicone oils.

Examples of the above polyolefins include resins such as polypropylene, polyethylene, and polybutene, which have softening points of 80° to 160° C. Examples of the above metal salts of fatty acids include metal salts of maleic acid with zinc, magnesium, and calcium; metal salts of stearic acid with zinc, cadmium, barium, lead, iron, nickel, cobalt, copper, aluminum, and magnesium; dibasic lead stearate; metal salts of oleic acid with zinc, magnesium, iron, cobalt, copper, lead, and calcium; metal salts of palmitic acid with aluminum and calcium; caprylates; lead caproate; metal salts of linoleic acid with zinc and cobalt; calcium ricinoleate; metal salts of ricinoleic acid with zinc and cadmium; and mixtures thereof. Examples of the above fatty acid esters include ethyl maleate, butyl maleate, methyl stearate, butyl stearate, cetyl palmitate, and ethylene glycol montanate. Examples of the above partially saponified fatty acid esters include montanic acid esters partially saponified with calcium. Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, selacholeic acid, and mixtures thereof. Examples of the above higher alcohols include dodecyl alcohol, lauryl alcohol, myristyl alcohol, palmityl alcohol, stearyl alcohol, arachyl alcohol, and behenyl alcohol. Examples of the above paraffin waxes include natural paraffins, microcrystalline waxes, synthetic paraffins, and chlorinated hydrocarbons. Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide, and N,N'-isophthalic bis-12-hydroxystearylamide. Examples of the above polyhydric alcohol esters include glycerol stearate, glycerol ricinolate, glycerol monobehenate, sorbitan monostearate, propylene glycol monostearate, and sorbitan trioleate. Examples of the above silicone varnishes include methylsilicone varnish and phenylsilicone varnish. Examples of the above aliphatic fluorocarbons include low polymerized compounds of tetrafluoroethylene and hexafluoropropylene, and fluorinated surfactants disclosed in Japanese Patent Laid-Open No. 53-124428. Among the above offset inhibitors, a preference is given to the polyolefins, with a particular preference given to polypropylene.

It is preferable to use the offset inhibitors in a proportion of 1 to 20% by weight, based on the resin contained in the core material.

In the present invention, a coloring agent is contained in the core material of the encapsulated toner, and any of the conventional dyes or pigments, which have been used for coloring agents for the toners may be used.

Examples of the coloring agents used in the present invention include various carbon blacks which may be produced by a thermal black method, an acetylene black method, a channel black method, and a lamp black method; a grafted carbon black, in which the surface of carbon black is coated with a resin; a nigrosine dye, Phthalocyanine Blue, Permanent Brown FG, Brilliant Fast Scarlet, Pigment Green B, Rhodamine-B Base, Solvent Red 49, Solvent Red 146, Solvent Blue 35, and the mixtures thereof. The coloring agent is usually used in an amount of about 1 to 15 parts by weight based on 100 parts by weight of the resin contained in the core material.

A magnetic encapsulated toner can be prepared by adding a particulate magnetic material to the core material. Examples of the particulate magnetic materials include ferrite, magnetite, ferromagnetic metals such as iron, cobalt, and nickel, alloys thereof, and compounds containing these elements; alloys not containing any ferromagnetic element which become ferromagnetic by suitable thermal treatment, for example, so-called "Heusler alloys" containing manganese and copper such as a manganese-copper-aluminum alloy, and a manganese-copper-tin alloy; and chromium dioxide, with a preference given to the compounds containing ferromagnetic metals, and a particular preference given to magnetite. Such a magnetic material is uniformly dispersed in the core material in the form of a fine powder having an average particle diameter of 0.1 to 1 μm. The content of these magnetic materials is 20 to 70 parts by weight, preferably 30 to 70 parts by weight, based on 100 parts by weight of the encapsulated toner.

When a particulate magnetic material is incorporated into the core material in order to make it a magnetic toner, the material may be treated in a similar manner to that of the coloring agent. Since a particulate magnetic material as such is poor in its affinity for organic substances, such as core materials and monomers, the material is used together with a known coupling agent such as a titanium coupling agent, a silane coupling agent or a lecithin coupling agent, with a preference given to the titanium coupling agent, or is treated with such a coupling agent prior to its use, thereby making it possible to uniformly disperse the particulate magnetic materials.

The encapsulated toners of the present invention are produced using the above starting materials preferably by in situ polymerization method from the viewpoint of simplicity in the production facilities and the production steps.

The method for production of the encapsulated toner by in situ polymerization is described hereinbelow.

In the method for production of the encapsulated toner of the present invention, the shell can be formed by utilizing the property that when a mixed solution comprising the core-constituting materials and the shell-forming material such as amorphous polyesters having the above-described viscoelasticity is dispersed in the aqueous dispersant, the shell-forming material localizes onto the surface of the liquid droplets. Specifically, the separation of the core-constituting materials and the shell-forming material in the liquid droplets of the mixed solution takes place due to the difference in the solubility indices, and the polymerization proceeds in this state to form an encapsulated structure. By this method, a shell is formed as a layer of shell-forming materials comprising an amorphous polyester with a substantially uniform thickness. Further, since the layer of this shell has a three-dimensional network structure or an islands-sea structure, in which a part of the core material is incorporated in the shell, the core material is likely to be released from the encapsulated toner upon fixing.

More precisely, the encapsulated toner of the present invention can be produced by the following steps (a) to (c):

(a) dissolving a shell-forming material into a polymerizable composition containing monomers of the core material resin, and a coloring agent;

(b) dispersing the mixture obtained in the step (a) in an aqueous dispersion medium; and (c) polymerizing the monomers contained in the dispersed phase.

In the above method, a dispersion stabilizer is required to be contained in the dispersion medium in order to prevent agglomeration and incorporation of the dispersed substances.

Examples of the dispersion stabilizers include gelatin, gelatin derivatives, polyvinyl alcohol, polystyrenesulfonic acid, hydroxymethylcellulose, hydroxyethylcellulose, hydroxypropylcellulose, sodium carboxymethylcellulose, sodium polyacrylate, sodium dodecylbenzenesulfonate, sodium tetradecyl sulfate, sodium pentadecyl sulfate, sodium octyl sulfate, sodium allyl alkyl polyethersulfonate, sodium oleate, sodium laurate, sodium caprate, sodium caprylate, sodium caproate, potassium stearate, calcium oleate, sodium 3,3-disulfonediphenylurea-4,4-diazobisamino-β-naphthol-6-sulfonate, o-carboxybenzeneazodimethylaniline, sodium 2,2,5,5-tetramethyltriphenylmethane-4,4-diazobis-β-naphtholdisulfonate, colloidal silica, alumina, tricalcium phosphate, ferrous hydroxide, titanium hydroxide, and aluminum hydroxide, with a preference given to tricalcium phosphate. These dispersion stabilizers may be used alone or in combination of two or more.

Examples of the dispersion media for the dispersion stabilizer include water, methanol, ethanol, propanol, butanol, ethylene glycol, glycerol, acetonitrile, acetone, isopropyl ether, tetrahydrofuran, and dioxane, among which water is preferably used as an essential component. These dispersion media can be used singly or in combination.

In the method for the production of the present invention, the amount of the shell-forming material comprising the above amorphous polyester as the main component is normally 3 to 50 parts by weight, preferably 5 to 40 parts by weight, more preferably 8 to 30 parts by weight, based on 100 parts by weight of the core material. When the amount of the shell-forming material is less than 3 parts by weight, the resulting shell becomes too thin in its thickness, thereby making the storage stability of the obtained toner poor. When the amount exceeds 50 parts by weight, dispersed droplets in the aqueous dispersion medium have an undesirably high viscosity, thereby making it difficult to produce fine drops, which in turn results in poor production stability.

In addition, for the purpose of charge control, the charge control agents exemplified above may be properly added to the shell-forming materials of the encapsulated toner of the present invention. Alternatively, the charge control agent may be used in a mixture with a toner. Since the shell itself controls chargeability, the amount of these charge control agents, if needed, can be minimized.

Although the particle diameter of the encapsulated toner produced by the method described above is not particularly limited, the average particle diameter is usually 3 to 30 μm. The thickness of the shell of the encapsulated toner is preferably 0.01 to 1 μm. When the thickness of the shell is less than 0.01 μm, the blocking resistance of the resulting toner becomes poor, and when the thickness exceeds 1 μm, the heat fusibility of the resulting toner becomes undesirably poor.

In the encapsulated toner of the present invention, a fluidity improver, or a cleanability improver may be used, if necessary. Examples of the fluidity improvers include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride, with a preference given to finely powdered silica.

The finely powdered silica is a fine powder having Si—O—Si linkages, which may be prepared by either the dry process or the wet process. The finely powdered silica may be not only anhydrous silicon dioxide but also any one of aluminum silicate, sodium silicate, potassium silicate, magnesium silicate, and zinc silicate, with a preference given to those containing not less than 85% by weight of $SiO_2$. Further, finely powdered silica surface-treated with a silane coupling agent, a titanium coupling agent, silicone oil, and silicone oil having an amine in the side chain thereof can be used.

The cleanability improvers include fine powders of metal salts of higher fatty acids typically exemplified by zinc stearate or fluorocarbon polymers.

Further, for the purpose of controlling the developability of the encapsulated toner, finely powdered polymers of methyl methacrylate of butyl methacrylate may be added.

Furthermore, for the purpose of controlling toning and frictional resistance of the surface of the toner, a small amount of carbon black may be used. The carbon blacks may be those conventionally known, including various kinds such as furnace black, channel black, and acetylene black.

When the encapsulated toner of the present invention contains a particulate magnetic material, it can be used alone as a developer, while when the encapsulated toner does not contain any particulate magnetic material, a non-magnetic one-component developer or a two-component developer can be prepared by mixing the toner with a carrier. Although the carrier is not particularly limited, examples thereof include iron powder, ferrite, glass beads, those of above with resin coatings, and resin carriers in which magnetite fine powders or ferrite fine powders are blended into the resins. The mixing ratio of the toner to the carrier is 0.5 to 20% by weight. The particle diameter of the carrier is 15 to 500 μm.

When the encapsulated toner of the present invention is fixed on a recording medium such as paper by heat and pressure, an excellent fixing strength is attained. As for the heat-and-pressure fixing process to be suitably used in the fixing of the toner of the present invention, any one may be used as long as both heat and pressure are applied. Examples of the fixing processes which can be suitably used in the present invention include a known heat roller fixing process; a fixing process as disclosed in Japanese Patent Laid Open No. 2-190870 in which visible images formed on a recording medium in an unfixed state are fixed by heating and fusing the visible images through the heat-resistant sheet with a heating means, comprising a heating portion and a heat-resistant sheet, thereby fixing the visible images onto the recording medium; and a heat-and-pressure process as disclosed in Japanese Patent Laid-Open No. 2-162356 in which the formed visible images are fixed on a recording medium through a film by using a heating element fixed to a support and a pressing member arranged opposite to the heating element in contact therewith under pressure.

EXAMPLES

The present invention is hereinafter described in more detail by means of the following working examples, comparative examples and test examples, but the present invention is not limited by these examples.

Resin Production Example

A propylene oxide adduct of bisphenol A (average adduct molar number: 2.2, hereinafter abbreviated as "BPA•PO"), an ethylene oxide adduct of bisphenol A (average adduct molar number: 2.2, hereinafter abbreviated as "BPA•EO"), terephthalic acid (hereinafter abbreviated as "TPA"), dodecenylsuccinic anhydride (hereinafter abbreviated as "DSA"), and trimellitic anhydride (hereinafter abbreviated as "TMA") are placed in a proportion shown in Table 1 in a two-liter four-necked glass flask equipped with a thermometer, a stainless steel stirring rod, a reflux condenser, and a nitrogen inlet tube, and heated at 220° C. in a mantle heater under a nitrogen gas stream while stirring to react the above components.

The degree of polymerization is monitored from a softening point measured by the method according to ASTM E 28-67, and the reaction is terminated when the softening point reaches 110° C., to give "Resin A."

The similar procedures are carried out to produce Resins B to D. The compositions thereof are shown in Table 1. Also, the glass transition temperature of each of the resins thus obtained (Resins A to D) is measured by the differential scanning calorimeter ("DSC MODEL 210," manufactured by Seiko Instruments, Inc.), and the values are shown together with the softening points, acid values, and mechanical loss tangents (tan δ) based on a dynamic viscoelasticity at 80° to 120° C. in Table 2. The acid values are measured by the method according to JIS K0070. Also, tan δ is measured at an angular frequency of 25 rad/s using "DYNAMIC ANALYZER RDA II" (manufactured by Rheometrics Inc.).

TABLE 1

| | (Molar Ratio of Monomer Components) | | | | | |
|---|---|---|---|---|---|---|
| Resin | BPA · PO | BPA · EO | Trimethylol-propane | TPA | DSA | TMA |
| A | 80 | 20 | — | 45 | 15 | 20 |
| B | 65 | 35 | — | 70 | 5 | 15 |
| C | 85 | — | 10 | 75 | 15 | — |
| D | 75 | 25 | — | 75 | 5 | — |

TABLE 2

| Resin | Softening Point (°C.) | Glass Transition Temperature (°C.) | Acid Value (KOHmg/g) | Tan δ (80–120° C.) |
|---|---|---|---|---|
| A | 110 | 63 | 10 | 1.40–5.00 |
| B | 110 | 72 | 18 | 1.22–10.60 |
| C | 110 | 65 | 10 | 2.01–9.85 |
| D | 110 | 69 | 15 | 2.58–72.10 |

Example 1

20.0 parts by weight of Resin A and 4.0 parts by weight of 2,2'-azobis(2,4-dimethylvaleronitrile) are added to a mixture comprising 72.0 parts by weight of styrene, 28.0 parts by weight of 2-ethylhexyl acrylate, 1.0 part by weight of divinylbenzene, and 7.0 parts by weight of carbon black "#44" (manufactured by Mitsubishi Kasei Corporation). The obtained mixture is introduced into an attritor ("MODEL MA-01SC," manufactured by Mitsui Miike Kakoki) and dispersed at 10° C. for 5 hours, to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo) at 15° C. and a rotational speed of 12000 rpm for 5 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are heated to 80° C. and reacted at 80° C. for 8 hours in a nitrogen atmosphere while stirring. After cooling the reaction product, the dispersing agent is dissolved into 10%- aqueous hydrochloric acid. The resulting product is filtered, and the obtained solid is washed with water, dried under a reduced pressure of 20 mmHg at 45° C. for 12 hours, and classified with an air classifier, to give an encapsulated toner with an average particle size of 8 μm whose shell comprises an amorphous polyester.

To 100.0 parts by weight of this encapsulated toner, 0.4 parts by weight of hydrophobic silica fine powder "Aerozil R-972" (manufactured by Nippon Aerozil Ltd.) are added and mixed to obtain the encapsulated toner according to the present invention. This toner is referred to as "Toner 1." The glass transition temperature ascribed to the resin contained in the core material is 38.9° C., and the softening point of Toner 1 is 127.3° C.

A cross section of Toner 1 is observed using a transmission electron microscope (manufactured by JEOL (Nihon Denshi Kabushiki Kaisha)). As is shown in the microphotograph of FIG. 1, it is observed that an average thickness of the shell is 0.5 μm, and that the core material is finely dispersed in a network structure formed by the shell resin comprising Resin A.

As described below, the lowest fixing temperature of Toner 1 is 110° C., and no high-temperature offset is initiated even at 200° C.

Example 2

20.0 parts by weight of Resin B and 4.0 parts by weight of 2,2'-azobisisobutyronitrile are added to a mixture comprising 68.0 parts by weight of styrene, 32.0 parts by weight of n-butyl acrylate, and 20.0 parts by weight of styrene-grafted carbon black "GPT-505P" (manufactured by Ryoyu Kogyo), to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo) at 15° C. and a rotational speed of 12000 rpm for 5 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are heated to 80° C. and reacted at 80° C. for 6 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 45° C. for 12 hours, and classified with an air classifier, to give an encapsulated toner with an average particle size of 8 μm whose shell comprises an amorphous polyester.

To 100.0 parts by weight of this encapsulated toner, 0.4 parts by weight of hydrophobic silica fine powder "Aerozil R-972" (manufactured by Nippon Aerozil Ltd.) are added and mixed to obtain the encapsulated toner according to the present invention. This toner is referred to as "Toner 2." The glass transition temperature ascribed to the resin contained in the core material is 30.9° C., and the softening point of Toner 2 is 132.7° C.

Figure 2:
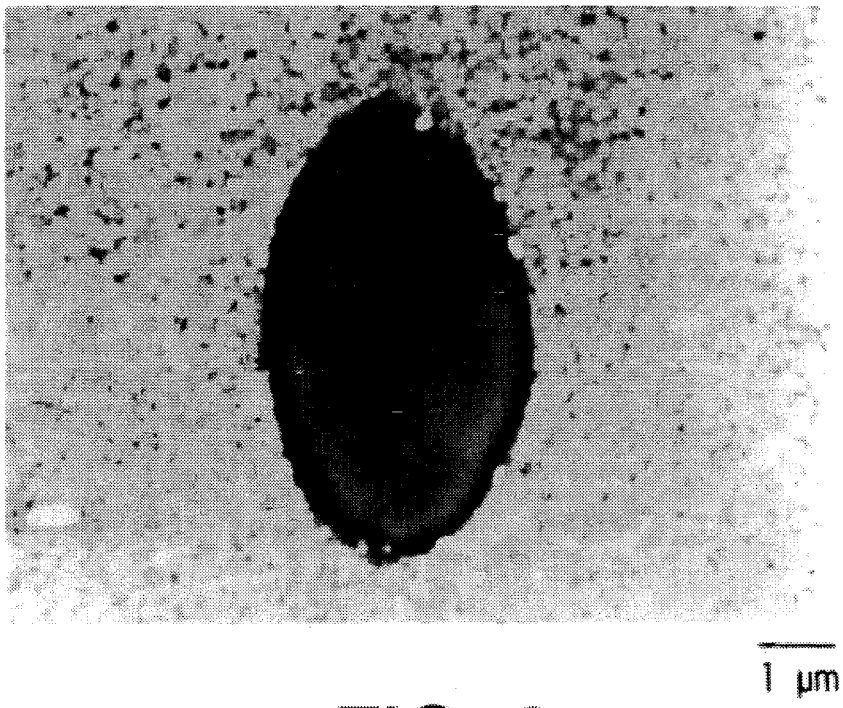
FIG. 2 is a microphotograph showing a grain structure of Toner 2 obtained in Example 2 by observing a cross section of Toner 2 using a transmission electron microscope.

A cross section of Toner 2 is observed using a transmission electron microscope (manufactured by JEOL (Nihon Denshi Kabushiki Kaisha)). As is shown in the microphotograph of FIG. 2, it is observed that an average thickness of the shell is 0.5 μm, and that the core material is finely dispersed in the shell resin comprising Resin B to form an islands-sea structure.

As described below, the lowest fixing temperature of Toner 2 is 105° C., and the high-temperature offset initiating temperature is 180° C.

Example 3

20.0 parts by weight of Resin C and 3.5 parts by weight of 2,2'-azobisisobutyronitrile are added to a mixture comprising 65.0 parts by weight of styrene, 35.0 parts by weight of 2-ethylhexyl acrylate, 0.9 parts by weight of divinylbenzene, and 7.0 parts by weight of carbon black "#44" (manufactured by Mitsubishi Kasei Corporation). The obtained mixture is introduced into an attritor ("MODEL MA-01SC," manufactured by Mitsui Miike Kakoki) and dispersed at 10° C. for 5 hours, to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo) at 15° C. and a rotational speed of 12000 rpm for 5 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are heated to 85° C. and reacted at 85° C. for 10 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 45° C. for 12 hours, and classified with an air classifier, to give an encapsulated toner with an average particle size of 8 μm whose shell comprises an amorphous polyester.

To 100.0 parts by weight of this encapsulated toner, 0.4 parts by weight of hydrophobic silica fine powder "Aerozil R-972" (manufactured by Nippon Aerozil Ltd.) are added and mixed to obtain the encapsulated toner according to the present invention. This toner is referred to as "Toner 3." The glass transition temperature ascribed to the resin contained in the core material is 30.2° C., and the softening point of Toner 3 is 122.5° C.

A cross section of Toner 3 is observed using a transmission electron microscope (manufactured by JEOL (Nihon Denshi Kabushiki Kaisha)). As a result, it is observed that an average thickness of the shell is 0.5 μm, and that the core material is finely dispersed in a network structure formed by the shell resin comprising Resin C.

As described below, the lowest fixing temperature of Toner 3 is 110° C., and the high-temperature offset initiating temperature is 200° C.

Comparative Example 1

The similar procedures to those of Example 1 are carried out up to the surface treatment step except that Resin A is replaced with Resin D, to give a comparative toner. This toner is referred to as "Comparative Toner 1." The glass transition temperature ascribed to the resin contained in the core material of Comparative Toner 1 is 39.1° C., and the softening point of Comparative Toner 1 is 125.5° C.

Figure 3:
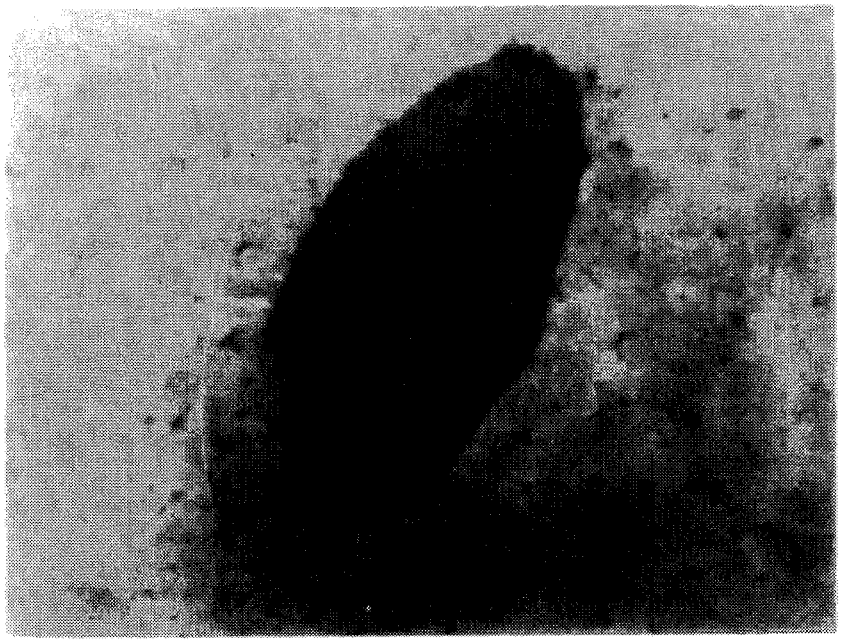
FIG. 3 is a microphotograph showing a grain structure of Comparative Toner 1 obtained in Comparative Example 1 by observing a cross section of Comparative Toner 1 using a transmission electron microscope.

A cross section of Comparative Toner 1 is observed using a transmission electron microscope (manufactured by JEOL (Nihon Denshi Kabushiki Kaisha)). As is shown in the microphotograph of FIG. 3, it is observed that the shell comprises a homogeneous layer consisting of Resin D alone, and that an average thickness of the shell is 0.2 μm.

As described below, the lowest fixing temperature of Comparative Toner 1 is 108° C., and the high-temperature offset initiating temperature is 145° C.

Comparative Example 2

40.0 parts by weight of styrene-grafted carbon black "GP-E-2" (manufactured by Ryoyu Kogyo), 10.0 parts by weight of a copolymer obtained by copolymerizing maleic anhydride, styrene, and 2-ethylhexyl acrylate (weight ratio of maleic anhydride: styrene: 2-ethylhexyl acrylate= 71:17:12; molecular weight=4250; glass transition temperature: 82° C.; tan δ=0.10 to 2.38 at 100° to 120° C.), 2.5 parts by weight of 2,2'-azobis(2,4-dimethylvaleronitrile), and 2.5 parts by weight of 2,2'-azobisisobutyronitrile are added to a mixture comprising 52.0 parts by weight of styrene, 32.0 parts by weight of 2-ethylhexyl acrylate, and 0.7 parts by weight of divinylbenzene, to give a polymerizable composition.

Next, 240 g of the above polymerizable composition is added to 560 g of a 4% by weight aqueous colloidal solution of tricalcium phosphate which is previously prepared in a two-liter separable glass flask. The obtained mixture is emulsified and dispersed with "T. K. HOMO MIXER, Model M" (manufactured by Tokushu Kika Kogyo) at 15° C. and a rotational speed of 12000 rpm for 5 minutes.

Next, a four-necked glass cap is set on the flask, and a reflux condenser, a thermometer, a nitrogen inlet tube, and a stainless steel stirring rod are attached thereto. The flask is placed in an electric mantle heater. Thereafter, the contents are heated to 80° C. and reacted at 80° C. for 6 hours in a nitrogen atmosphere while stirring. After cooling the reaction product, the dispersing agent is dissolved into 10%-aqueous hydrochloric acid. The resulting product is filtered, and the obtained solid is washed with water, dried under a reduced pressure of 20 mmHg at 45° C. for 12 hours, and classified with an air classifier, to give an encapsulated toner with an average particle size of 8 μm.

To 100.0 parts by weight of this encapsulated toner, 0.4 parts by weight of hydrophobic silica fine powder "Aerozil R-972" (manufactured by Nippon Aerozil Ltd.) are added and mixed to obtain a comparative encapsulated toner. This toner is referred to as "Comparative Toner 2." The glass transition temperature ascribed to the resin contained in the core material of Comparative Toner 2 is 27.2° C., and the softening point of Comparative Toner 2 is 116.4° C.

A cross section of Comparative Toner 2 is observed using a transmission electron microscope (manufactured by JEOL (Nihon Denshi Kabushiki Kaisha)). As a result, it is observed that the shell comprises a homogeneous layer consisting of a copolymer of maleic anhydride, styrene, and 2-ethylhexyl acrylate, and that an average thickness of the shell is 0.2 μm.

As described below, the lowest fixing temperature of Comparative Toner 2 is 109° C., and the high-temperature offset initiating temperature is 150° C.

Test Example

A developer is prepared by placing 6 parts by weight of each of the toners obtained in Examples 1 to 3, Comparative Examples 1, and 2 and 94 parts by weight of spherical ferrite powder coated with styrene-methyl methacrylate copolymer resin having a particle size of 250 mesh-pass and 400 mesh-on into a polyethylene container, and mixing the above components by rotation of the container on the roller at a rotational speed of 150 rpm for 20 minutes. The resulting developer is evaluated with respect to the triboelectric charge, the fixing ability, and the offset resistance.

(1) Triboelectric Charge

The triboelectric charge is measured by a blow-off type electric charge measuring device as described below. Specifically, a specific charge measuring device equipped with a Faraday cage, a capacitor, and an electrometer is used. First, W (g) (about 0.15 to 0.20 g) of the developer prepared above is placed into a brass measurement cell equipped with a stainless screen of 500 mesh, which is adjustable to any mesh size to block the passing of the carrier particles. Next, after aspirating from a suction opening for 5 seconds, blowing is carried out for 5 seconds under a pressure indicated by a barometric regulator of 0.6 kgf/cm$^2$, thereby selectively removing only the toner from the cell.

In this case, the voltage of the electrometer after 2 seconds from the start of blowing is defined as V (volt). Here, when the electric capacitance of the capacitor is defined as C (μF), the triboelectric charge Q/m of this toner can be calculated by the following equation:

$$Q/m\ (\mu C/g)=C\times V/m$$

Here, m is the weight of the toner contained in W (g) of the developer. When the weight of the toner in the developer is defined as T (g) and the weight of the developer as D (g), the toner concentration in a given sample can be expressed as T/D×100(%), and m can be calculated as shown in the following equation:

$$m\ (g)=W\times(T/D)$$

The measurement results of the triboelectric charge of the developer prepared under normal conditions (23° C., 50% RH) are shown in Table 3.

In addition, the triboelectric charge of the toners after copying 50,000 sheets is measured by loading each of the developer on a commercially available electrophotographic copy machine (equipped with a selene-arsenic photoconductor; a fixing roller having a rotational speed of 255 mm/sec; and a toner concentration of 6%). The results are shown in Table 3. Also, the image quality determined by the extent of background generated during the continuous copying test and the toner dust in the device are also evaluated and shown together in Table 3.

TABLE 3

| | Triboelectric Charge (μC/g) (23° C., 50% RH) | | | |
|---|---|---|---|---|
| | | After Copying | During Continuous Copying Test | |
| | At Start | 50,000 Sheets | Image Quality | Toner Dust in Machine |
| Toner 1 | −25.1 | −24.9 | Good | None |
| Toner 2 | −26.3 | −26.8 | Good | None |
| Toner 3 | −22.4 | −22.7 | Good | None |
| Comparative Toner 1 | −25.2 | −25.2 | Good | None |
| Comparative Toner 2 | −27.8 | −28.0 | Good | None |

(2) Fixing Ability

The fixing ability is evaluated by the method as described below. Specifically, each of the developers prepared as described above is loaded on a commercially available electrophotographic copy machine to develop images. The copy machine is equipped with a selene-arsenic photoconductor; a fixing roller having a rotational speed of 40 mm/sec; a fixing device with variable heat-and-pressure and temperature; and an oil applying device being removed from the copy machine. By controlling the fixing temperature from 70° C. to 200° C., the fixing ability of the formed images is evaluated. The results are shown in Table 4.

The lowest fixing temperature used herein is the temperature of the fixing roller at which the fixing ratio of the toner exceeds 70%. This fixing ratio of the toner is determined by placing a load of 500 g on a sand rubber eraser (LION No. 502) having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Process Measurements Co., and then calculating the fixing ratio from this density value and a density value before the eraser treatment using the following equation.

$$\text{Fixing ratio} = \frac{\text{Image density after eraser treatment}}{\text{Image density before eraser treatment}} \times 100$$

(3) Offset Resistance

The offset resistance is evaluated by measuring the temperature of the low-temperature offset disappearance and the temperature of the high-temperature offset initiation using the same testing apparatus under the same testing conditions as in the fixing ability test. Specifically, copying tests are carried out by raising the temperature of the heat roller surface at an increment of 5° C. in the range from 70° C. to 200° C., and at each temperature, the adhesion of the toner onto the heat roller surface for fixing is evaluated with naked eye. The results are also shown in Table 4.

TABLE 4

| | Lowest Fixing Temp. (°C.) | Low-Temp. Offset Disappearing Temp. (°C.) | High-Temp. Offset Initiating Temp. (°C.) |
|---|---|---|---|
| Toner 1 | 110 | 70 | >200 |
| Toner 2 | 105 | 70 | 180 |
| Toner 3 | 110 | 80 | 200 |
| Comparative Toner 1 | 108 | 70 | 145 |
| Comparative Toner 2 | 109 | 70 | 150 |

As is clear from Table 3, with respect to Toners 1 through 3 according to the present invention and Comparative Toners 1 and 2, the values for the triboelectric charges are appropriate, showing only a small change of triboelectric charge after copying 50,000 sheets, thereby maintaining excellent image quality, and no toner dust is generated in the machine.

As is clear from Table 4, each of Toners 1 through 3 has a low lowest fixing temperature and a wide non-offset region. By contrast, each of Comparative Toners 1 and 2 has a low high-temperature offset initiating temperature and a narrow non-offset region, even though its lowest fixing temperature is low.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An encapsulated toner for heat-and-pressure fixing comprising a heat-fusible core material containing at least a thermoplastic resin and a coloring agent, and a shell formed thereon so as to cover the surface of the core material, said shell having a structure in which a part of the heat-fusible core material is incorporated therein, wherein the shell has an islands-sea structure in which a part of the heat-fusible core material is dispersed as islands.

2. The encapsulated toner for heat-and-pressure fixing according to claim 1, wherein said shell contains a thermoplastic resin having a mechanical loss tangent (tan δ) in the range of from 1.0 to 20.0 based on the dynamic viscoelasticity, when measured with a sine stress having an angular frequency of 25 rad/s at a temperature of from 80° to 120° C.

3. The encapsulated toner for heat-and-pressure fixing according to claim 2, wherein the thermoplastic resin of the shell is an amorphous polyester.

4. The encapsulated toner for heat-and-pressure fixing according to claim 3, wherein the amorphous polyester has an acid value of 3 to 50 KOH mg/g.

5. The encapsulated toner for heat-and-pressure fixing according to claim 3, wherein the amorphous polyester has a ratio of a weight-average molecular weight (Mw) to a number-average molecular weight (Mn), i.e. Mw/Mn, of not less than 5.

6. The encapsulated toner for heat-and-pressure fixing according to claim 1, wherein the glass transition temperature ascribed to the thermoplastic resin is 10° C. to 50° C.

7. The encapsulated toner for heat-and-pressure fixing according to claim 6, wherein the thermoplastic resin is a vinyl resin.

8. The encapsulated toner for heat-and-pressure fixing according to claim 1, wherein the shell contains a thermoplastic resin having a mechanical loss tangent (tan δ) in the range of from 1.0 to 10.0 based on the dynamic viscoelasticity, when measured with a sine stress having an angular frequency of 25 rad/s at a temperature of from 80° to 120° C.

9. A method for producing an encapsulated toner for heat-and-pressure fixing comprising a heat-fusible core material containing at least a thermoplastic resin and a coloring agent, and a shell formed thereon so as to cover the surface of the core material, the method comprising the steps of:

preparing an amorphous polyester by polymerizing alcohol monomers and acid component monomers to give a ratio of a weight-average molecular weight (Mw) to a number-average molecular weight (Mn), i.e. Mw/Mn, of not less than 5 using monomers of trihydric or higher polyhydric alcohols and/or tricarboxylic or higher polycarboxylic acid components in a total amount of not less than 5 mol %, based on the entire polyester resin monomers;

dissolving the amorphous polyester into a polymerizable composition containing monomers of a heat-fusible core material and dispersing a mixture obtained thereby in an aqueous dispersion medium to give a dispersed composition; and carrying out in situ polymerization of the dispersed composition to form a shell having an islands-sea structure in which a part of the heat-fusible core material is dispersed as islands, the amorphous polyester having a mechanical loss tangent (tan δ) in the range of from 1.0 to 20.0 based on the dynamic viscoelasticity, when measured with a sine stress having an angular frequency of 25 rad/s at a temperature of from 80° to 120° C.

* * * * *